US006523820B2

(12) United States Patent
Gustafson et al.

(10) Patent No.: US 6,523,820 B2
(45) Date of Patent: Feb. 25, 2003

(54) NON-PLANAR SINGLE SHEET SEPARATOR WALL AND APPARATUS

(75) Inventors: Michael Gustafson, San Diego, CA (US); Paul McCarty, San Diego, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 64 days.

(21) Appl. No.: 09/792,843

(22) Filed: Feb. 23, 2001

(65) Prior Publication Data

US 2002/0117799 A1 Aug. 29, 2002

(51) Int. Cl.[7] ..... B65M 3/52; B65H 3/32

(52) U.S. Cl. ..... 271/10.01; 271/10.09; 271/121; 271/109; 271/113; 271/145; 271/162

(58) Field of Search ..... 271/121, 10.01, 271/10.09, 109, 113, 145, 162, 167, 264

(56) References Cited

U.S. PATENT DOCUMENTS

| | | | | | |
|---|---|---|---|---|---|
| 4,136,861 | A | * | 1/1979 | Goff, Jr. | 271/113 |
| 5,533,721 | A | * | 7/1996 | Takashimizu | 271/10.12 |
| 5,653,433 | A | * | 8/1997 | Ishizuka | 271/121 |
| 5,857,671 | A | * | 1/1999 | Kato et al. | 271/10.11 |
| 6,086,062 | A | * | 7/2000 | Nakamura et al. | 271/121 |
| 6,095,515 | A | * | 8/2000 | Kiyohara et al. | 271/121 |
| 6,126,161 | A | * | 10/2000 | Kato | 271/114 |
| 6,168,150 | B1 | * | 1/2001 | Hori et al. | 271/121 |
| 6,398,205 | B1 | * | 6/2002 | Nakamura et al. | 271/124 |

FOREIGN PATENT DOCUMENTS

| | | | |
|---|---|---|---|
| JP | 6382242 | * | 4/1988 |
| JP | 61514 | * | 1/1994 |
| JP | 6179540 | * | 6/1994 |

* cited by examiner

*Primary Examiner*—Donald P. Walsh
*Assistant Examiner*—Jonathan R Miller

(57) ABSTRACT

A non-planar single sheet separator wall preferably inclined at about 25° from the vertical away from a paper stack first engages the side corners of the leading edge of a sheet of paper or other media picked from the top of the generally horizontal or downwardly inclined stack by a roller or pusher and causes the corners of the sheet to first curl upwardly along the wall before the central portion of the leading edge of the sheet engages the central portion of the separator wall. The separator wall configuration substantially eliminates downward curling of one or both leading corners of a sheet which is purposely upwardly bowed by an elastomeric pad near the center of the separator wall to reduce multi-sheet picks and separator jams.

12 Claims, 3 Drawing Sheets

NON-PLANAR SINGLE SHEET SEPARATOR WALL AND APPARATUS

CROSS REFERENCE TO RELATED APPLICATIONS

None.

BACKGROUND OF THE INVENTION

The present invention relates generally to the art of paper and document handling for computer controlled printers, document scanners, automatic document feeders and other applications and, more particularly, to apparatus capable of separating single sheets of media such as paper, vellum, transparencies, etc. from a stack thereof.

Automatic document processing apparatus such as scanners and desktop printers typically include a shelf or tray for holding a stack of one or more sheets of documents to be scanned or blank paper or other media to be fed, one sheet at a time, from the stack to the other portions of the document processing apparatus. In typical prior art arrangements a top sheet pusher or driven pick roller having a friction surface is used to engage the uppermost sheet in a horizontally oriented or downwardly inclined stack to strip the top sheet from the stack and move it parallel to the surface of the stack toward an upwardly angled single sheet separator wall. Engagement of the leading edge of the sheet with the surface of the separator wall, which is usually inclined from vertical at approximately 25°, causes the single sheet to move upwardly to the operative portions of the printer, scanner or other type of document handling equipment. The prior art separator wall employs a flat or planar surface or a plurality of spaced upwardly extending rails which have low friction paper engaging surfaces which occupy a common plane. Typically, the rails are made of Teflon coated steel strips which are costly due to the use of coated metal parts. Other separator wall configurations use plastic surfaces to form the wall which, however, are less reliable than the Teflon coated steel strips in reducing the jam rate of the single sheet separator apparatus.

Angled wall paper separator systems further often include a rubber pad or the equivalent near the center to provide additional restraint to reduce the rate of multi-sheet picks. It is desirable for the rubber pad to cause a small, localized buckle in the sheet being picked; however, a high rate of paper jams occurs with particularly light weight paper which has a tendency for the leading edge of the sheet to curl downwardly upon engagement with the angled wall instead of sliding up the paper path.

It is objective of the present invention to reduce the rate of paper jamming and multi-sheet picks in separators using an angled separator wall.

SUMMARY OF THE INVENTION

The present invention therefore provides a single sheet separator wall for a single sheet separator apparatus, said wall having a sheet engaging surface for contacting and guiding the leading edge of a sheet which is moved from the top of a stack of sheets into contact with said surface to guide movement of said sheet in a direction generally parallel to said sheet engaging surface, said surface including inner and outer guide areas which extend in said direction, said outer guide areas arranged to contact side portions of the leading edge of a sheet to curl the sides of the sheet prior to engagement of said leading edge of said sheet with said inner guide area.

DETAILED DESCRIPTION OF THE PREFERRED EMBODIMENT

The separator wall 10 of the present invention is preferably made of molded Teflon loaded plastic having a generally rectangular configuration and is placed proximate a stack S of sheets to be separated and angled from the vertical in the range of 20–30°, preferably at about 25°. The stack may be supported on a removable tray 12 having a bottom which may be upwardly biased by a spring toward a downwardly spring biased pick roller 16. The separator wall may also have a lower integrally formed lip 18 for guiding the tray 12 to the proper position relative to the separator wall 10 and appropriately configured wall mounting structure such as hooks and apertures (unnumbered) for affixing the wall 10 in place in the sheet handling apparatus in which it is used.

Figure 2:
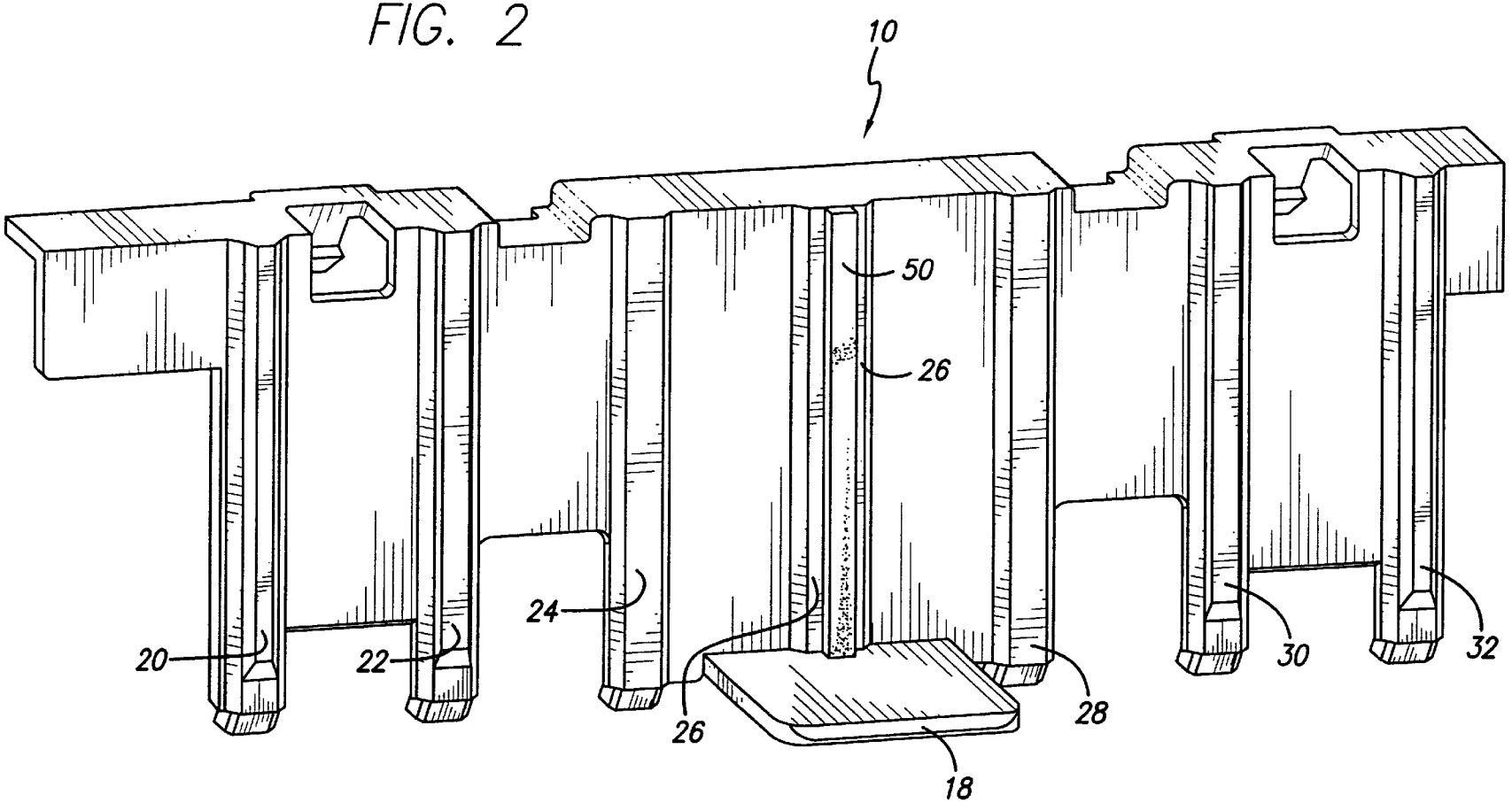
FIG. 2 is a perspective view of a non-planar separator wall used in the separator apparatus of FIG. 1.
Figure 3:
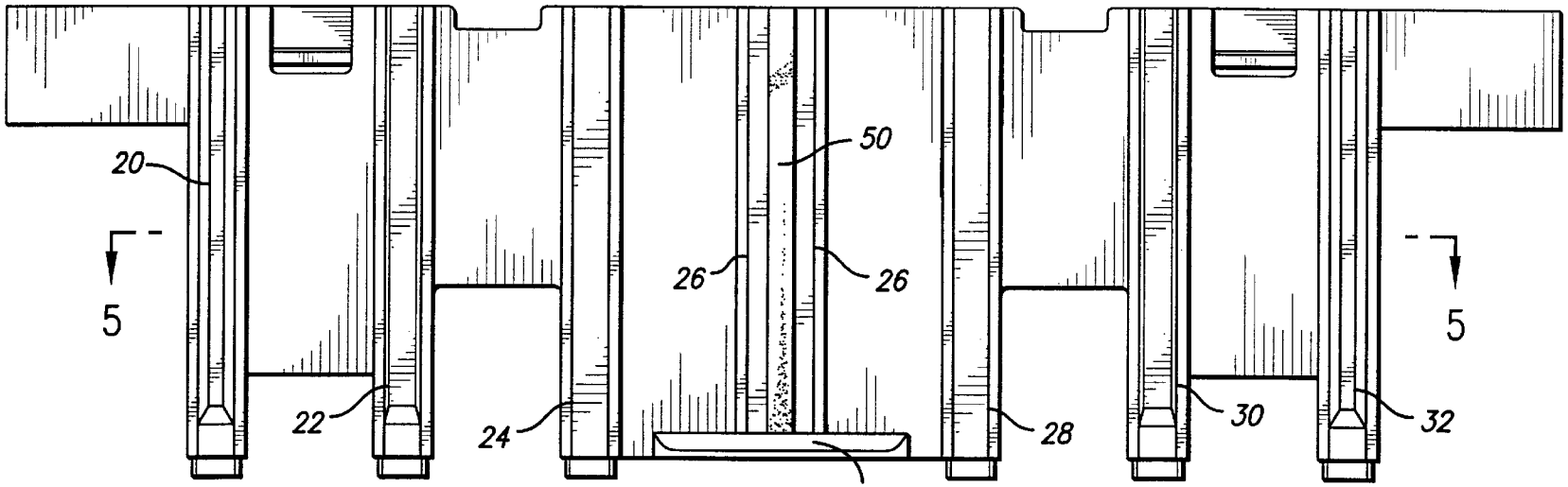
FIG. 3 is a front elevation view of the non-planar separator wall.
Figure 5:
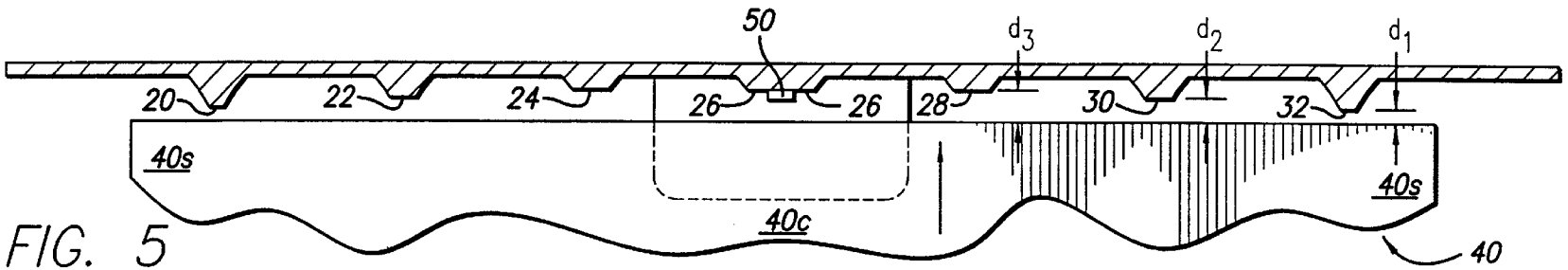
FIG. 5 is a cross-section of the separator wall taken at line 5—5 of FIG. 3.

The separator wall 10 in the configuration shown has a plurality of longitudinally generally upwardly extending sheet contacting rails 20, 22, 24, 26, 28, 30, 32 and having a sheet contacting configuration best seen in FIGS. 2 and 5 where it can be seen that the rails 20, 22, 24, 26, 28, 30, 32 present generally upwardly inclined sheet guide surfaces arranged at unequal distances d1, d2, d3 from the straight leading edge of a sheet 40 in the stack S as best seen in FIG. 5. The individual sheet contacting surfaces of the rails 20, 22, 24, 26, 28, 30, 32 may have special inserts such as Teflon coated steel to provide very low friction sheet contacting surfaces although the extra expense of providing Teflon coated steel rails is not necessary if the plastic wall is sufficiently slippery due, for example, to significant Teflon loading therein. The sides 40S of the leading edge of the uppermost sheet 40 or sheets removed from the stack S by the paper pick roller 12 (which a person skilled in the art will appreciate may be one or more driven rollers arranged on a common axis) or by a pusher, first engage the outermost rails 20, 32 furthest from the centerline of the sheet in the direction of sheet movement and subsequently the leading edge of the sheet 40 engages progressively inner rails 22,30, then 24, 28 as the sheet progresses up the separator wall 10. This results in a curling of the lateral sides of each sheet upwardly prior to engagement of the leading edge of the sheet with the inner guide rails 22, 24, 26, 28, 30. Once the center 40C of the leading edge of the sheet has advanced far enough to contact the center rail 26 of the separator wall, the leading corners and side edges 40S of the sheet have already been partially advanced up the wall 10 and are thus prevented from curling downwardly as is sometimes experienced in prior art sheet separator walls which use a generally planar sheet engaging surface.

Figure 1:
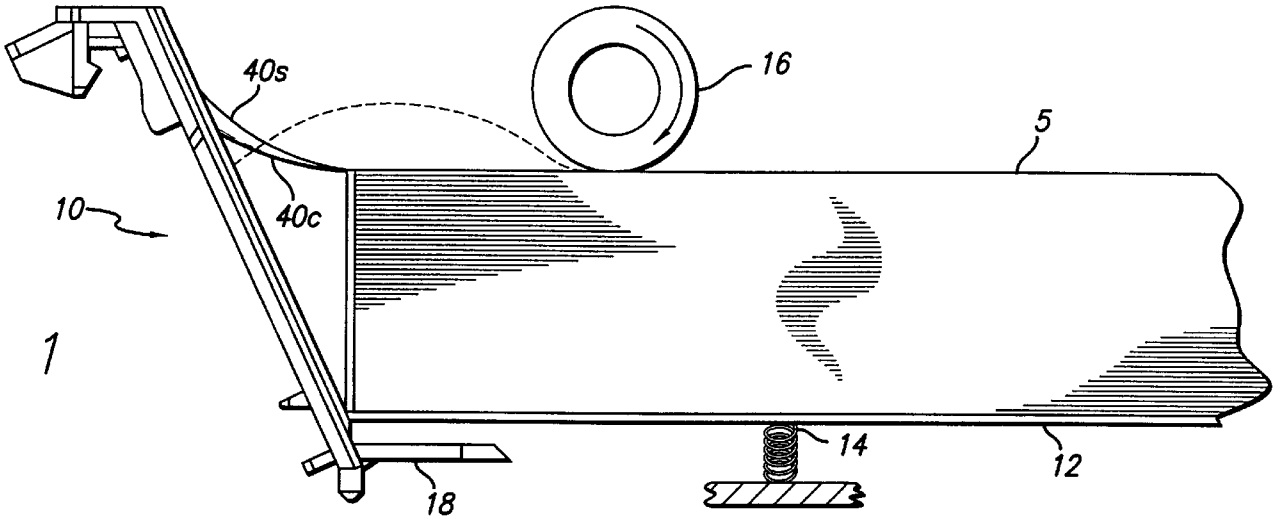
FIG. 1 is a schematic side elevation view of an angled wall single sheet separator apparatus.

Although not essential, an elastomeric separator pad 50 of rubber or the like which projects slightly toward the sheet 40 preferably is mounted in an upwardly extending recess in the central rail 26 of the separator wall. As the center of the leading edge of the sheet engages the elastomeric pad 50, the pad causes a small upward buckle in the sheet to form which assists in reliably separating multi-sheet picks to ensure that only a single sheet progresses upwardly along the separator wall 10. The phantom line shown in FIG. 1 shows the manner in which one or more picked sheets can incorrectly bow upward upon contact with an elastomeric separator pad at the center of a prior art flat separator wall.

As shown in FIGS. 2 and 5, the surface or, in the preferred embodiment plural surfaces, of the spaced rails 20, 22, 24, 26, 28, 30, 32 of the separator wall which contact the leading edge of the sheets to be separated do not lie in a straight line or occupy a flat plane or as in the prior art. Rather, the surfaces as seen in FIG. 5 can be said to be arranged along a curved line or occupy a somewhat curved plane as seen in FIG. 5. Accordingly, the sheet contacting side of the separator wall 10 of the present invention presents a somewhat concavely bowed configuration to the leading edges of the sheets 40 to be separated.

Spaced sheet contacting rails are not essential since those skilled in the art will readily understand that the non-planar separator wall 10 can merely be a continuous arcuate surface or-other suitable configuration which presents a sheet contacting surface or surfaces which lie along a curved plane.

Figure 4:
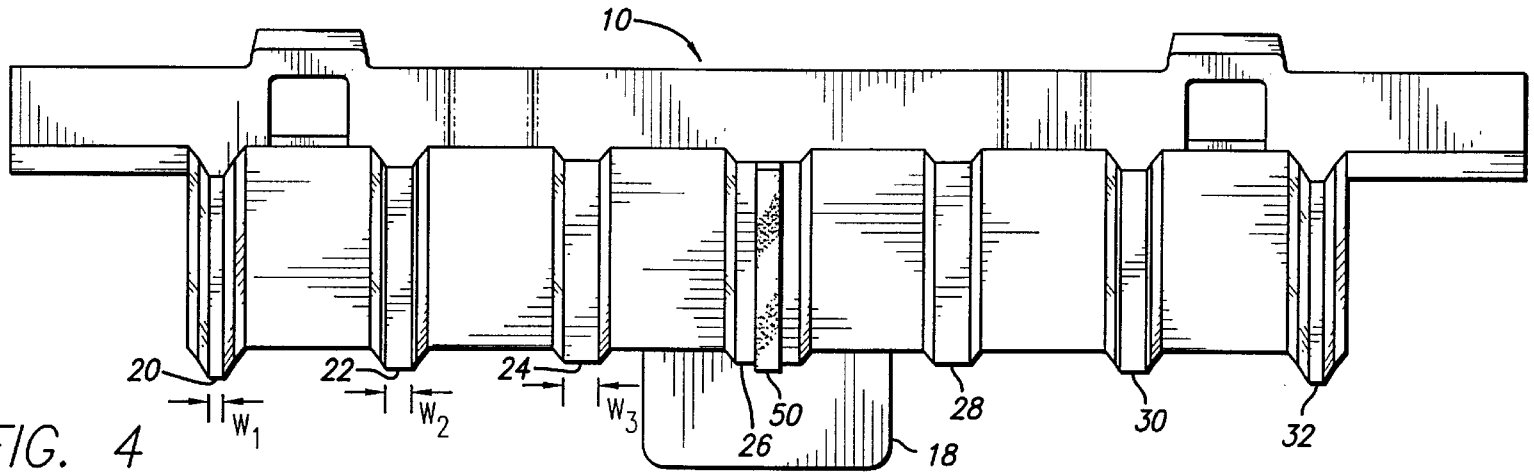
FIG. 4 is a top plan view of the non-planar separator wall.

It will be noted that in FIG. 2, seven sheet contacting rails having sheet contacting surfaces are shown but, of course, the number of spaced rails or sheet contacting surfaces is not critical. Also, the width W1, W2, W3, of each sheet contacting surface of each rail may increase from the outer edges of the separator wall toward the center as seen in FIG. 4 but here again, this feature is not considered essential. The essence of the invention is a wall configuration which causes the lateral or side edges of each sheet 40 to first contact the wall 10 before the center of the sheet contacts the wall so that the side edges will first curve upwardly before the central portion of the leading edge of the sheet engages the wall 10 or the elastomeric separator pad 50, if present.

Persons skilled in the art will also appreciate that various additional modifications can be made in the preferred embodiment shown and described above and that the scope of protection is limited only by the wording of the claims which follow.

What is claimed is:

1. A single sheet separator wall for a single sheet separator apparatus, said wall having a sheet engaging surface for contacting and guiding the leading edge of a sheet which is moved from the top of a stack of sheets into contact with said surface which extends at an angle in the range of 110° to 120° away from said top of said stack of sheets to guide movement of said sheet in a direction generally parallel to said sheet engaging surface, said surface including inner and outer guide areas which extend in said direction, said outer guide areas arranged to contact side portions of the leading edge of a sheet to curl the sides of the sheet prior to engagement of said leading edge of said sheet with said inner guide area.

2. The separator wall of claim 1, wherein said inner guide area which engages said sheet is substantially intermediate the lateral edges of said sheet.

3. The separator wall of claim 2, further comprising an elastomeric sheet engaging pad on said inner guide area for engaging a central portion of the leading edge of a sheet.

4. The separator wall of claim 3, wherein said outer sheet guide areas comprise spaced sheet guide rails.

5. The separator wall of claim 4, wherein said inner sheet guide area comprises a center rail having a recess and said elastomeric pad is mounted in and protrudes from said recess in said center rail.

6. A single sheet separator apparatus comprising a stack support for holding a stack of sheets to be individually separated, a driven sheet separator wheel having an annular surface for frictionally engaging and moving a sheet edgewise from said stack and a single sheet separator wall proximate one edge of said stack, said wall having a sheet engaging surface for contacting and guiding the leading edge of said sheet which is moved from the top of said stack to change the direction of movement of said sheet to a direction which extends along said sheet engaging surface, said sheet engaging surface making an angle in the range of 110–120 with said stack support, said surface having inner and outer guide areas which extend in said direction, said outer guide areas being configured to contact side portions of the leading edge of a sheet to curl said side portions of the sheet prior to engagement of said leading edge of said sheet with said inner guide area.

7. The apparatus of claim 6, wherein said outer sheet guide areas comprise spaced sheet guide rails.

8. The apparatus of claim 7, wherein said rails are configured such that the leading edge of said sheet first engages rails proximate lateral edges of said sheet and progressively engages rails spaced inwardly of the lateral edges of said sheet.

9. The apparatus of claim 8, wherein one of said rails is a center rail, said center rail engaging said leading edge of said sheet substantially intermediate the lateral edges of said sheet subsequent to engagement of said leading edge with the other rails.

10. The apparatus of claim 9, further comprising an elastomeric sheet engaging pad mounted in said center rail.

11. The apparatus of claim 6, wherein said stack support is substantially horizontal and said wall extends upwardly and away from said stack support and is angled away from the vertical in the range of 20–30°.

12. The apparatus of claim 11, wherein said wall is angled away from said stack support about 115°.

* * * * *